United States Patent [19]

Gardner et al.

[11] Patent Number: 4,995,202

[45] Date of Patent: Feb. 26, 1991

[54] NOZZLE UNIT AND METHOD FOR USING WET ABRASIVES TO CLEAN HARD SURFACES

[75] Inventors: Jeffrey G. Gardner, Traverse City; Dennis J. Gulau, Kingsley, both of Mich.

[73] Assignee: The Dow Chemical Company, Midland, Mich.

[21] Appl. No.: 515,146

[22] Filed: Apr. 26, 1990

[51] Int. Cl.[5] ..... B24C 5/04

[52] U.S. Cl. ..... 51/439; 51/427

[58] Field of Search ..... 51/439, 427, 321, 436

[56] References Cited

U.S. PATENT DOCUMENTS

| | | | |
|---|---|---|---|
| 2,440,334 | 4/1948 | Gerlach | 51/439 |
| 2,489,097 | 11/1949 | Luce | 51/439 X |
| 2,503,743 | 4/1950 | Keefer | 51/439 |
| 2,543,517 | 2/1951 | Anderson | 51/439 X |
| 2,832,346 | 1/1958 | Fisher | 51/439 X |

*Primary Examiner*—D. S. Meislin

*Attorney, Agent, or Firm*—V. Dean Clausen

[57] ABSTRACT

The invention is a nozzle unit designed for use with wet abrasive materials to clean hard surfaces, such as steel structures. The nozzle unit is formed from two nozzle bodies, which are joined together. Each body has a lengthwise bore therein, with a venturi structure, and a metallic liner is fitted into each bore. Inside the nozzle unit is an annular cavity, which is connected into a source of water and a mixing chamber. The nozzle unit also has air passages therein that connect the mixing chamber with air surrounding the nozzle unit. In a wet blasting operation, an abrasive material, such as sand, is directed into the mixing chamber, where it mixes with water and air to form a wet abrasive stream. The wet stream is then discharged from the nozzle onto the structure to be cleaned.

1 Claim, 1 Drawing Sheet

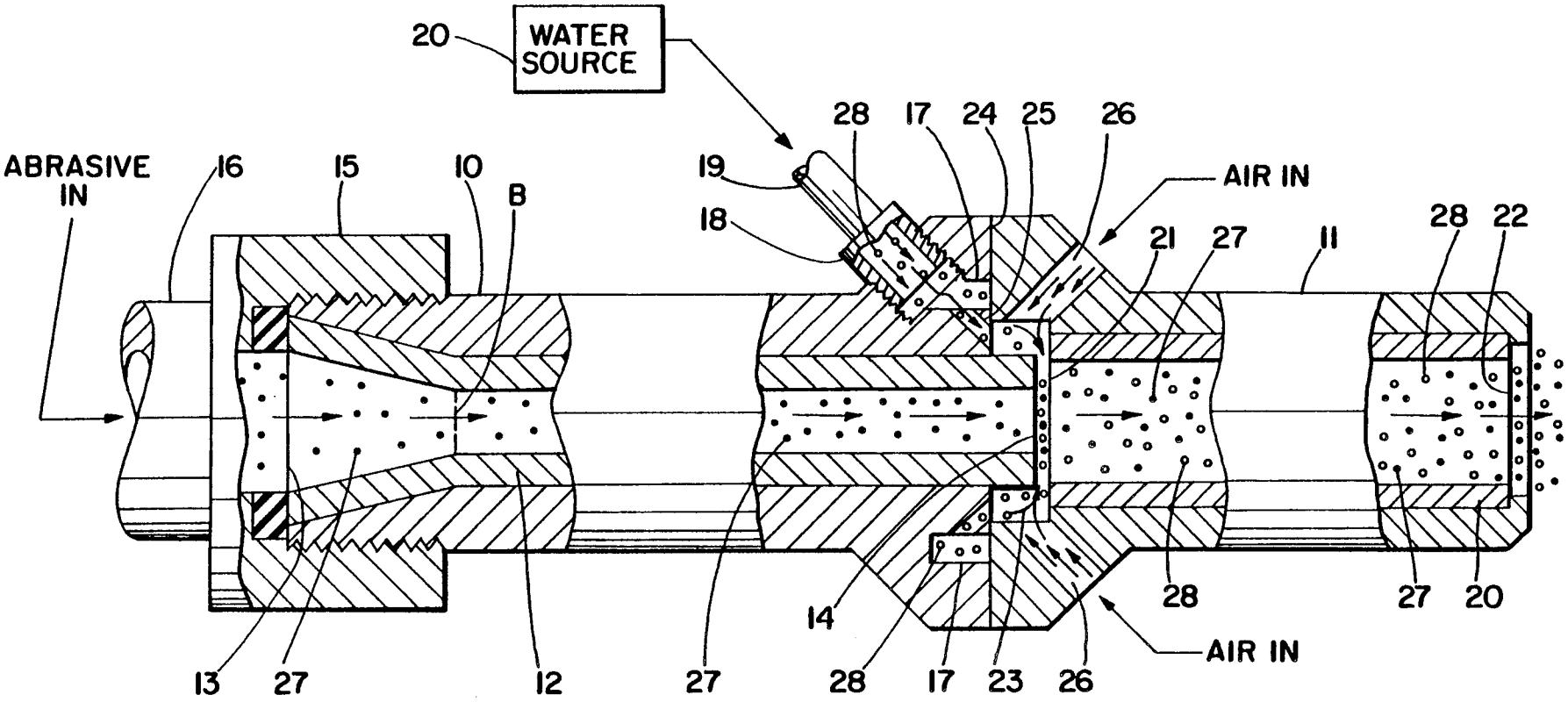
22
28
20
27
11
AIR IN
27
21
28
AIR IN
26
26
25
23
24
17
17
28
28
14
19
18
27
WATER SOURCE
20
B
10
12
15
27
16
13
ABRASIVE IN

NOZZLE UNIT AND METHOD FOR USING WET ABRASIVES TO CLEAN HARD SURFACES

BACKGROUND OF THE INVENTION

This invention relates to a wet abrasive blasting procedure for cleaning hard surfaces, such as steel or concrete structures. In particular, the invention provides a nozzle unit designed especially for using wet abrasive materials in cleaning operations.

Dry abrasive blasting is a technique that has been used for many years to remove rust, scale, old paint, etc. from steel structures, such as pipelines, highway bridges, storage tanks, and from other hard surfaces, such as brick and concrete. A common abrasive material used in this cleaning operation is a standard grade of silica sand. During such an operation the free silica creates a significant amount of dust in the atmosphere near the surface being blasted.

Since the silica dust pollutes the environment, many states have enacted laws in the last few years that restrict the amount of abrasive material that can be released into the atmosphere. One attempt to solve the dust problem is wet abrasive blasting. This method is now widely used in many industrial cleaning operations, because it suppresses a considerable amount of the dust usually generated in a dry blasting operation.

The "water shroud", method is one form of a wet abrasive blasting operation. This method involves attaching a "water" ring to the outer tip of a conventional, long venturi blast nozzle. As the air-sand stream exits the nozzle, water is pumped through holes in the ring, so that it impinges on this stream and "wests down" the sand.

The water shroud method has several drawbacks. For example, it uses excessive amounts of water, because the blast stream (air and sand) tends to blow the water out of its path as it exits the blast nozzle. And the more water that is injected into the blast stream, the more it reduces the velocity of the sand and air. This results in a lower production rate, because it takes longer to complete a given job.

Another type of wet abrasive blasting is the "water injection" method. In this method, water is injected into the blast stream before it enters the blast nozzle. The water is injected at a pressure above that of the line pressure of the blast stream (about 100 psi), so that it can mix well with the sand. This method also uses large amounts of water, and it requires a pump capable of exceeding the line pressure.

Another wet abrasive blasting method used very high pressure water (from about 600–20,000 psi) as the primary force. This system employs a special nozzle head that creates negative pressure induced by the venturi structure of a conventional blast nozzle. The sand abrasive is carried through a suction hose and mixes with the water stream before the water and sand enter the nozzle bore. This system also uses large amounts of water, and the velocity of the blast stream is too low for good abrasive impingement.

SUMMARY OF THE INVENTION

The invention is directed to a nozzle unit and method for using wet abrasive materials to clean hard surfaces, such as metal and concrete structures. The nozzle unit is made up of two nozzle bodies, first and second, that are joined together. The first nozzle body has a lengthwise bore, with a venturi structure, extending through it, and a metal liner is fitted into the bore. The liner has a receiving end, and a discharge end, with the receiving end having the larger diameter. The receiving end is also connected into a source for supplying an abrasive material, such as sand, to the nozzle unit.

Inside the first nozzle body is an annular cavity that surrounds the lengthwise bore, and an inlet port that communicates with the cavity and with a source of water. The second nozzle body also has a lengthwise bore therein, which has a venturi structure, and a metal liner is fitted into the bore. The liner has a receiving end with a smaller diameter than the discharge end of the liner. There is also a mixing chamber inside the second nozzle body, which communicates with the discharge end of the liner in the first nozzle body and the receiving end of the liner in the second nozzle body.

There are also several water passages in the first nozzle body that connect the annular cavity with the mixing chamber. And in the second nozzle body there are several air passages that connect the mixing chamber with air surrounding the nozzle unit.

In the use of the nozzle unit in a wet blasting operation, the silica sand (or other abrasive material) is directed into the bore in the first nozzle body, and is carried through into the mixing chamber. At the same time, water is directed into the annular cavity through the inlet port in the first nozzle body, and from the cavity into the mixing chamber. Air is also drawn into the mixing chamber through the air passages. The sand, water, and air mix together in the mixing chamber, to form the wet abrasive stream, which moves down the bore in the second nozzle body, and is discharged onto the surface to be cleaned.

DESCRIPTION OF THE DRAWINGS

The single FIGURE of the drawing is a front elevation view, mostly in section, of the nozzle unit of this invention.

DESCRIPTION OF THE INVENTION

Referring to the drawing, the nozzle unit of this invention is made up of two cylindrical nozzle bodies. Numeral 10 designates the first nozzle body, and numeral 11 refers to th second nozzle body. A central bore having a venturi structure extends lengthwise through the body 10. Inserted snugly in the bore is a metal liner 12, in which the receiving end 13 of the venturi structure has a larger diameter than the discharge end 14. A coupling 15 is threaded onto the nozzle body 10 at the receiving end 13, and the coupling is, in turn, connected into a supply line 16.

Line 16 is connected into a tank, or similar container (not shown), which contains abrasive material. The discharge end 14 of liner 12 extends slightly beyond a face (not numbered) of body 10 that is normal to the lengthwise bore. Body 10 also includes an annular cavity 17 that surrounds the lengthwise bore. A fitting 18 is threaded into the nozzle body 10, such that it communicates with the cavity 17. The fitting is, in turn, connected into a line 19, and the other end of the line connects into a source of low pressure water, indicated by numeral 20.

The nozzle body 11 also has a central bore, with a venturi structure, that extends lengthwise through the body. Fitted snugly into the bore is a metal liner 20, in which the receiving end 21 of the venturi structure has a smaller diameter than the discharge end 22. A mixing chamber 23 is formed at the front end of the bore in body 11, and the discharge end 14 of liner 12 projects into the chamber. As shown in the drawing, nozzle body 10 has a face (referred to above) that mates with a similar face on nozzle body 11. These faces form a common surface 24 for joining the bodies together with suitable fasteners, such as socket head screws (not shown).

Referring again to nozzle body 10, there are several, small diameter passages 25 that connect the annular cavity 17 into mixing chamber 23. In the operation of the nozzle unit, water is carried from cavity 17 into the mixing chamber through these passages. In nozzle body 11 there are several passages 26 that extend from mixing chamber 23 to the outer surface of the nozzle body. These passages provide means for drawing air into the mixing chamber during operation of the nozzle unit.

The nozzle units used in the practice of this invention are available in several different sizes. Three different dimensions of the unit are used in specifying nozzle size. One dimension is the inside diameter (ID) of the receiving end 13 of the metal liner 12, which is referred to as the "entry" size. Another dimension is the bore size, which is the ID of the throat section in the venturi structure of the liner bore, as indicated by the letter B in the drawing. The overall length of the nozzle unit is the other dimension used to express nozzle size. The usual entry sizes are from ½ to 1 ¼ inches; the bore sizes are from ¼ inch to ½ inch; and the nozzle lengths are from 5 ¾ inches to 9 inches.

OPERATION

The present invention can be illustrated by the following example, which describes how the nozzle unit is used in a typical wet abrasive blasting operation. The entry size of the nozzle unit used in this example was 1 inch, the bore size was 7/16 of an inch, and the overall length of the unit was 8 ¼ inches. The abrasive material was a standard grade of silica sand, 30–80 mesh, which was contained in a pressurized tank; and air consumption of the nozzle unit was about 255 CFM.

The first step is to start the flow of the sand 27 and the air into the nozzle unit. The sand is directed into the bore in liner 12, at about 100 psig, and is carried into mixing chamber 23. When the sand moves through throat section B in the venturi structure of liner 12, the pressure inside the liner bore drops. The pressure drop creates a vacuum effect that draws air into chamber 23 through the passages 26. At the same time, the water flow from source 20 is started, and the water 28 moves into the mixing chamber through line 19, fitting 18, cavity 17, and passages 25.

The water, sand, and air mix together in chamber 23 to form a wet abrasive stream. From chamber 23, the stream is carried down the bore of liner 20 and through the discharge end 22 of the liner. As the stream is discharged from the nozzle unit, it strikes the surface to be cleaned (not shown).

In the operation described above, the hard surface to be cleaned was a metal trailer bed that was coated with rust (not shown). To establish a control point, the trailer bed was first blasted for about three (3) minutes, using only sand and air, i.e. a dry blast operation. The operator noted that the highly abrasive airborne dust carried about 300 feet from the point where the abrasive stream contacted the trailer bed (impact point).

In the second phase of the operation, water was inducted into the nozzle unit, to mix with the sand and air, as described above. The trailer bed was again blasted with the wet abrasive stream for about three (3) minutes. The water source 20 was a standard city water tap, at about 20 psig; and the water flow rate through the nozzle unit was about one (1) quart per minute. The operator noted that the airborne abrasive dust carried about 75 feet from the point of impact.

In a third phase of this operation, the trailer bed was again blasted with the wet abrasive stream for about three (3) minutes; and the water flow rate through the nozzle unit was about two (2) quarts per minute. In this operation, it was noted that the abrasive dust was visible in the air for about 30 feet from the point of impact.

The fourth phase of the operation involved blasting the trailer bed for the same length of time (about 3 minutes), but the water flow through the nozzle unit was at a maximum rate of about 6 quarts per minute. In this operation the sand dust was completely saturated, and the mist generated at the point of impact carried for only about 20 feet through the air.

In the practice of this invention, therefore, use of the nozzle unit described herein in a wet blasting operation has several advantages over the conventional systmes described earlier. These advantages include:

(1) The wet abrasive stream can be maintained at a high velocity as it moves through the nozzle unit, and the abrasive dust is suppressed almost completely. As a result, the nozzle unit is a very efficient tool for cleaning hard surfaces, such as steel or concrete.

(2) Water can be inducted into the nozzle unit from any low pressure source, such as a water tap, or a storage tank. This enables the nozzle to use a minimum amount of water and still maintain a high rate of production in a cleaning operation.

(3) The wet blasting operation can be conducted without requiring a pump or other means for injecting water at high pressure into the blast stream. Since this nozzle unit doesn't require the extra equipment, the cleaning system itself is much cheaper and much easier to operate than the systems now available.

In addition to silica sand, there are many other abrasive materials that can be used in the practice of this invention. Examples of these materials are slag minerals, glass beads, plastics, and other materials that don't dissolve in water. The nozzle body liners can be fabricated of materials such as tungsten carbide, silicon carbide, silicon nitride, and boron carbide.

The invention claimed is:

1. A nozzle unit for use with wet abrasive materials to clean hard surfaces, the unit comprising:

a first nozzle body having a lengthwise bore therein, the bore defining a venturi structure, and including a fist metallic liner having a receiving end and a discharge end, the receiving end of the liner having a larger diameter than the discharge end of said liner, and the receiving end being connected into a source for supplying an abrasive material to the nozzle unit;

the first nozzle body including a joiner face that is normal to the lengthwise bore, and the discharge end of the metallic liner extending beyond the joiner face;

the first nozzle body further including an annular cavity that surrounds the lengthwise bore, the cavity having an open side along the joiner face, and said nozzle body including an inlet port that communicates with the annular cavity and a source of water;

a second nozzle body having a lengthwise bore therein, the bore defining a venturi structure, and including a second metallic liner with a receiving end, and a discharge end, the receiving end of the liner having a smaller diameter than the discharge end of said liner;

the second nozzle body including a joiner face that is normal to the lengthwise bore, and the first and second nozzle bodies being fastened together at their joiner faces;

the second nozzle body further including a mixing chamber, the mixing chamber communicating with the discharge end of the first liner, and the receiving end of the second liner;

the first nozzle body including several water passages that connect the annular cavity with the mixing chamber;

the second nozzle body of the second cylindrical part including several air passages that connect the mixing chamber with air surrounding the nozzle unit;

wherein, in operation, an abrasive material is directed into the lengthwise bore of the first nozzle body and is carried into the mixing chamber in the second nozzle body;

water is directed through the inlet port in the first nozzle body, and into the annular cavity therein, and is carried from the annular cavity through the water passages into the mixing chamber;

air is drawn into the mixing chamber through the air passages in the second nozzle body;

the abrasive material, water, and air are mixed together in the mixing chamber, to form a wet abrasive stream; and the wet abrasive stream is carried down the lengthwise bore in the second nozzle body, and is discharged from the nozzle unit onto a hard surface to be cleaned.

* * * * *